US011377708B2

(12) United States Patent
Hasegawa et al.

(10) Patent No.: US 11,377,708 B2
(45) Date of Patent: *Jul. 5, 2022

(54) HIGH-STRENGTH GALVANIZED STEEL SHEET AND METHOD FOR PRODUCING THE SAME

(71) Applicant: JFE Steel Corporation, Tokyo (JP)

(72) Inventors: Hiroshi Hasegawa, Tokyo (JP); Tatsuya Nakagaito, Tokyo (JP); Gosuke Ikeda, Tokyo (JP); Hiromi Yoshitomi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 224 days.

This patent is subject to a terminal disclaimer.

(21) Appl. No.: 16/473,377

(22) PCT Filed: Dec. 27, 2017

(86) PCT No.: PCT/JP2017/046839

§ 371 (c)(1),
(2) Date: Jun. 25, 2019

(87) PCT Pub. No.: WO2018/124157

PCT Pub. Date: Jul. 5, 2018

(65) Prior Publication Data

US 2020/0190617 A1 Jun. 18, 2020

(30) Foreign Application Priority Data

Dec. 27, 2016 (JP) ..... JP2016-253302

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 6/008* (2013.01); *C21D 8/0205* (2013.01);
(Continued)

(58) Field of Classification Search
CPC ..... C21D 9/46; C21D 6/005; C21D 6/008; C21D 8/0205; C21D 8/0226;
(Continued)

(56) References Cited

U.S. PATENT DOCUMENTS 9,783,878 B2 10/2017 Wakabayashi et al.
2011/0024006 A1 2/2011 Schötter et al.
(Continued)

FOREIGN PATENT DOCUMENTS

CN 101600812 A 12/2009
CN 103842543 A 6/2014
(Continued)

OTHER PUBLICATIONS

Chinese Office Action with Search Report for Chinese Application No. 201780080488.5, dated Oct. 9, 2020, 12 pages.
(Continued)

*Primary Examiner* — Christopher S Kessler
*Assistant Examiner* — Andrew M Cheung
(74) *Attorney, Agent, or Firm* — RatnerPrestia

(57) ABSTRACT

Provided are a high-strength galvanized steel sheet and a method for producing the high-strength galvanized steel sheet. The high-strength galvanized steel sheet includes a base steel sheet having a specific composition and a microstructure including ferrite and carbide-free bainite, martensite and carbide-containing bainite, and retained austenite, the total area fraction of ferrite and carbide-free bainite being 0% to 65%, the total area fraction of martensite and carbide-containing bainite being 35% to 100%, and the area
(Continued)

GAPS IN GALVANIZING LAYER fraction of retained austenite being 0% to 15%, the content of diffusible hydrogen in the base steel sheet being 0.00008% by mass or less (including 0%) and a galvanizing layer disposed on the base steel sheet. The density of gaps in the galvanizing layer, that the gaps cutting across the entire thickness of the galvanizing layer, is 10 gaps/mm or more.

8 Claims, 2 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/58*** | (2006.01) |
| ***C23C 2/02*** | (2006.01) |
| ***C23C 2/06*** | (2006.01) |
| ***C23C 2/40*** | (2006.01) |

(52) U.S. Cl.
CPC ..... *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/26* (2013.01); *C22C 38/28* (2013.01); *C22C 38/32* (2013.01); *C22C 38/38* (2013.01); *C22C 38/58* (2013.01); *C23C 2/02* (2013.01); *C23C 2/06* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 8/0236; C21D 8/0263; C21D 2211/001; C21D 2211/002; C21D 2211/005; C21D 2211/008; C22C 38/001; C22C 38/002; C22C 38/005; C22C 38/008; C22C 38/02; C22C 38/04; C22C 38/06; C22C 38/12; C22C 38/14; C22C 38/16; C22C 38/26; C22C 38/28; C22C 38/32; C22C 38/38; C22C 38/58; C23C 2/02; C23C 2/06; C23C 2/40
See application file for complete search history.

(56) References Cited

U.S. PATENT DOCUMENTS

| | | | | |
|---|---|---|---|---|
| 2012/0222781 | A1* | 9/2012 | Azuma | C25D 5/36 148/518 |
| 2014/0193665 | A1 | 7/2014 | Kawata et al. | |
| 2014/0234657 | A1 | 8/2014 | Azuma et al. | |
| 2017/0275726 | A1 | 9/2017 | Hasegava et al. | |
| 2017/0313028 | A1* | 11/2017 | Kawata | C22C 38/06 |
| 2017/0314116 | A1* | 11/2017 | Kawata | B32B 15/04 |
| 2019/0040511 | A1 | 2/2019 | Hasegawa et al. | |

FOREIGN PATENT DOCUMENTS

| | | | |
|---|---|---|---|
| CN | 104245999 | A | 12/2014 |
| EP | 2738280 | A1 | 6/2014 |
| EP | 2738283 | A1 | 6/2014 |
| EP | 2762583 | A1 | 8/2014 |
| EP | 3216887 | A1 | 9/2017 |
| JP | 0633213 | A | 2/1994 |
| JP | 2006037130 | A | 2/2006 |
| JP | 2009035793 | A | 2/2009 |
| JP | 2009068039 | A | 4/2009 |
| JP | 2010255113 | A | 11/2010 |
| JP | 5971434 | B2 | 8/2016 |
| WO | 2011065591 | A1 | 6/2011 |
| WO | 2013018726 | A1 | 2/2013 |
| WO | 2013047820 | A1 | 4/2013 |
| WO | 2013047830 | A1 | 4/2013 |
| WO | 2016072477 | A1 | 5/2016 |
| WO | 2017131054 | A1 | 8/2017 |

OTHER PUBLICATIONS

Extended European Search Report for European Application No. 17 888 494.6, dated Oct. 18, 2019, 10 pages.
International Search Report and Written Opinion for International Application No. PCT/JP2017/046839, dated Apr. 10, 2018—7 pages.
Non Final Office Action for U.S. Appl. No. 16/072,904, dated Dec. 21, 2021, 12 pages.

* cited by examiner

EXAMPLES OF CARBIDE IN BAINITE

GAPS IN GALVANIZING LAYER

HIGH-STRENGTH GALVANIZED STEEL SHEET AND METHOD FOR PRODUCING THE SAME

CROSS REFERENCE TO RELATED APPLICATIONS

This is the U.S. National Phase application of PCT/JP2017/046839, filed Dec. 27, 2017, which claims priority to Japanese Patent Application No. 2016-253302, filed Dec. 27, 2016, the disclosures of these applications being incorporated herein by reference in their entireties for all purposes.

FIELD OF THE INVENTION

The present invention relates to a high-strength galvanized steel sheet and a method for producing the high-strength galvanized steel sheet that are suitable for automotive components.

BACKGROUND OF THE INVENTION

Steel sheets used for producing automotive components have been required to have high strengths from the view point of improving the collision safety and the fuel economy of automobiles. Since an increase in the strength of a steel sheet commonly leads to the degradation of the workability of the steel sheet, the development of a steel sheet being excellent in both high strength and workability has been required. Generally, steel sheets are subjected to shearing in a blanking line and then to pressing. Since the sheared portions of the steel sheets have been deformed significantly, cracking is likely to occur starting from the sheared portions during the pressing. In particular, in the case of high-strength galvanized steel sheets having a tensile strength (hereinafter, TS) of 1000 MPa or more, the above issue becomes obvious and, for example, the component or the shape to which such steel sheets can be applied may be problematically limited.

Patent Literature 1 discloses a technique that relates to a hot-dip galvanized steel sheet in which the volume fractions of a plurality of martensite components having different properties are adjusted in order to achieve excellent hole expandability. Patent Literature 2 discloses a technique that relates to a hot-dip galvanized steel sheet in which the hardness, volume fraction, grain size, and the like of martensite are adjusted in order to achieve excellent stretch flange formability.

PATENT LITERATURE

PTL 1: Domestic Re-publication of PCT International Publication for Patent Application No. 2013-47830

PTL 2: Japanese Patent No. 5971434

SUMMARY OF THE INVENTION

However, in Patent Literature 1 and Patent Literature 2, any consideration is given to neither diffusible hydrogen present in the base steel sheet included in the galvanized steel sheet nor the conditions of the galvanizing layer and there is room for improvement.

A high-strength galvanized steel sheet is necessarily applied to a part that comes into contact with water from the viewpoint of corrosion prevention. For strengthening such anticorrosive parts, it is important to reduce occurrence of cracking starting from a sheared portion of the high-strength galvanized steel sheet (i.e., sheared edge cracking). It is important to achieve both a workability good enough to address the cracking and a high strength.

Aspects of the present invention were made in order to address the above-described issues. An object according to aspects of the present invention is to provide a high-strength galvanized steel sheet capable of reducing occurrence of sheared edge cracking and a method for producing the high-strength galvanized steel sheet.

The inventors of the present invention conducted extensive studies in order to address the above issues and, as a result, found that, in the case where any consideration is given to neither diffusible hydrogen present in a base steel sheet nor gaps formed in a galvanizing layer, cracking due to deformation of the sheared portion may occur significantly even when the steel microstructure is composed primarily of hard microstructures. On the basis of the above finding, the inventors found that the above-described issues may be addressed by adjusting the composition of the steel sheet to be a specific composition, adjusting the microstructure of the steel sheet to be a specific microstructure, and adjusting the concentration of diffusible hydrogen in a base steel sheet of a galvanized steel sheet and the density of gaps that cut across the entire thickness of a galvanizing layer in a cross section of the galvanized steel sheet, the cross section being taken in the thickness direction so as to be perpendicular to the rolling direction. Thus, the present invention was made. More specifically, aspects of the present invention provide the following.

[1] A high-strength galvanized steel sheet including a base steel sheet having a composition containing, by mass, C: 0.05% to 0.30%, Si: 3.0% or less, Mn: 1.5% to 4.0%, P: 0.100% or less, S: 0.02% or less, and Al: 1.0% or less, with the balance being Fe and inevitable impurities, the base steel sheet having a microstructure including ferrite and carbide-free bainite, martensite and carbide-containing bainite, and retained austenite, the total area fraction of ferrite and carbide-free bainite being 0% to 65%, the total area fraction of martensite and carbide-containing bainite being 35% to 100%, and the area fraction of retained austenite being 0% to 15%, the content of diffusible hydrogen in the base steel sheet being 0.00008% by mass or less (including 0%); and a galvanizing layer disposed on the base steel sheet, wherein the density of gaps in the galvanizing layer, the gaps cutting across the entire thickness of the galvanizing layer in a cross section of the steel sheet, the cross section being taken in a thickness direction of the steel sheet so as to be perpendicular to a rolling direction of the steel sheet, is 10 gaps/mm or more.

[2] The high-strength galvanized steel sheet described in [1], wherein desorption of the diffusible hydrogen peaks at a temperature in the range of 80° C. to 200° C.

[3] The high-strength galvanized steel sheet described in [1] or [2], wherein the composition further containing one or more elements selected from, by mass, Cr: 0.005% to 2.0%, Mo: 0.005% to 2.0%, V: 0.005% to 2.0%, Ni: 0.005% to 2.0%, Cu: 0.005% to 2.0%, Nb: 0.005% to 0.20%, Ti: 0.005% to 0.20%, B: 0.0001% to 0.0050%, Ca: 0.0001% to 0.0050%, REM: 0.0001% to 0.0050%, Sb: 0.0010% to 0.10%, and Sn: 0.0010% to 0.50%.

[4] The high-strength galvanized steel sheet described in any one of [1] to [3], wherein the galvanizing layer is an alloyed galvanizing layer.

[5] A method for producing a high-strength galvanized steel sheet, the method including an annealing step in which a hot-rolled or cold-rolled steel sheet having the composition described in [1] or [3] is subjected to heating to an annealing temperature of 750° C. or more, then held as needed, and subsequently subjected to cooling such that an average cooling rate in a range of 550° C. to 700° C. is 3° C./s or more, the amount of retention time during which the steel sheet is held in a temperature range of 750° C. or more in the heating and the cooling being 30 seconds or more; a galvanizing step in which, subsequent to the annealing step, the annealed steel sheet is galvanized and subsequently, as needed, subjected to an alloying treatment; a bending-unbending step in which the galvanized steel sheet is bent and unbent in a direction perpendicular to a rolling direction of the steel sheet at a bend radius of 500 to 1000 mm in a temperature range of Ms to Ms−200° C. during cooling performed subsequent to the galvanizing step, each of the bending and the unbending being performed once or more; a retention step in which the galvanized steel sheet is held for 3 s or more until the temperature reaches 100° C. after having been subjected to the bending-unbending step; and a final cooling step in which the galvanized steel sheet is cooled to 50° C. or less after having been subjected to the retention step.

[6] The method for producing a high-strength galvanized steel sheet described in [5], wherein, in the annealing step, the $H_2$ concentration at the annealing temperature is 30% by volume or less.

[7] The method for producing a high-strength galvanized steel sheet described in [5] or [6], wherein, in the annealing step, the $H_2$ concentration during the cooling performed in the temperature range of 550° C. to 700° C. is 30% by volume or less.

A product, such as a component, having excellent resistance to sheared portion cracking may be produced using the high-strength galvanized steel sheet according to aspects of the present invention.

DETAILED DESCRIPTION OF EMBODIMENTS OF THE INVENTION

Figure 1:
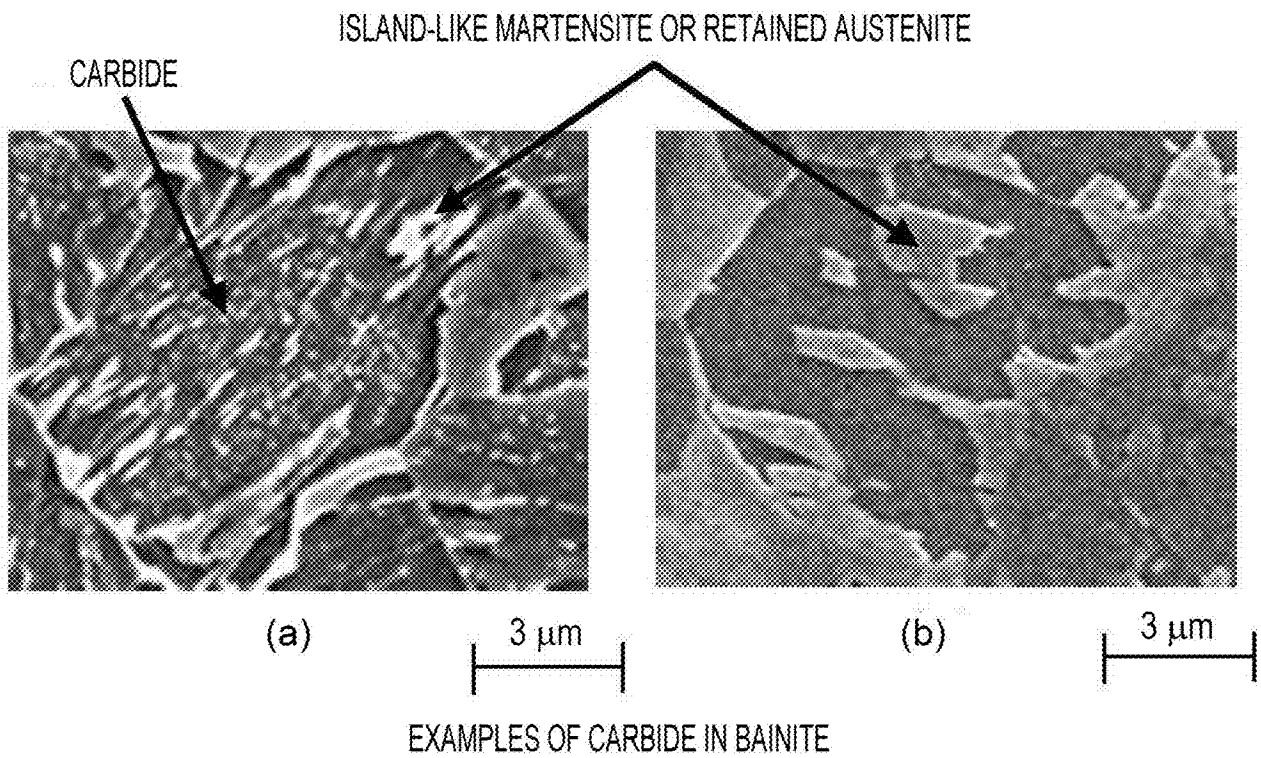
FIG. 1 includes diagrams illustrating carbide-free bainite and carbide-containing bainite.

An embodiment of the present invention is described below. The present invention is not limited by the following embodiment.

<High-Strength Galvanized Steel Sheet>

The high-strength galvanized steel sheet according to aspects of the present invention includes a base steel sheet and a galvanizing layer formed on the base steel sheet. First, the base steel sheet is described. The galvanizing layer is described subsequently.

The base steel sheet has a specific composition and a specific microstructure. In the description of the base steel sheet, the composition of the base steel sheet and the microstructure of the base steel sheet are described in this order. In the description of the composition of the base steel sheet, the symbol "%" denotes "% by mass" when referring to the content of a constituent.

C: 0.05% to 0.30%

C is an element that causes the formation of martensite and carbide-containing bainite and thereby effectively increases the tensile strength (TS) of the steel sheet. If the C content is less than 0.05%, the above advantageous effects may fail to be achieved sufficiently and a TS of 1000 MPa or more may fail to be achieved. If the C content exceeds 0.30%, hardening of martensite may occur, which degrades resistance to sheared portion cracking. Accordingly, the C content is limited to be 0.05% to 0.30%. The minimum C content is preferably 0.06% or more and is more preferably 0.07% or more. The maximum C content is 0.28% or less and is more preferably 0.26% or less.

Si: 3.0% or Less (Excluding 0%)

Si is an element that causes the solid-solution strengthening of steel and thereby effectively increases the TS of the steel sheet. If the Si content exceeds 3.0%, the steel may become brittle and resistance to sheared portion cracking may become degraded. Accordingly, the Si content is limited to be 3.0% or less, is preferably 2.5% or less, and is more preferably 2.0% or less. The minimum Si content is preferably, but is not limited to, 0.01% or more and is more preferably 0.50% or more.

Mn: 1.5% to 4.0%

Mn is an element that causes the formation of martensite and carbide-containing bainite and thereby effectively increases the TS of the steel sheet. If the Mn content is less than 1.5%, the above advantageous effects may fail to be achieved sufficiently. In addition, ferrite and carbide-free bainite, which are undesirable in accordance with aspects of the present invention, may be formed and, consequently, a TS of 1000 MPa or more may fail to be achieved. If the Mn content exceeds 4.0%, the steel may become brittle and resistance to sheared portion cracking may become degraded. Accordingly, the Mn content is limited to be 1.5% to 4.0%. The minimum Mn content is preferably 2.0% or more, is more preferably 2.3% or more, and is still more preferably 2.5% or more. The maximum Mn content is preferably 3.7% or less, is more preferably 3.5% or less, and is still more preferably 3.3% or less.

P: 0.100% or Less (Excluding 0%)

Since P may degrade resistance to sheared portion cracking, it is desirable to reduce the P content to a minimum level. The P content allowable in accordance with aspects of the present invention is 0.100% or less. The minimum P content is not specified but preferably 0.001% or more because the production efficiency may be reduced if the P content is less than 0.001%.

S: 0.02% or Less (Excluding 0%)

Since S may degrade resistance to sheared portion cracking, it is preferable to reduce the S content to a minimum level. The S content allowable in accordance with aspects of the present invention is 0.02% or less. The minimum S content is not specified but preferably 0.0005% or more, because the production efficiency may be reduced if the S content is less than 0.0005%.

Al: 1.0% or Less (Excluding 0%)

Al serves as a deoxidizing agent and is preferably used when deoxidation is performed. From the view point of using Al as a deoxidizing agent, the Al content is preferably 0.01% or more. Addition of an excessive amount of Al may cause ferrite and carbide-free bainite, which are undesirable in accordance with aspects of the present invention, to be formed in large amounts, or it may cause martensite and carbide-containing bainite to be formed in smaller amounts. Thus, a TS of 1000 MPa or more may fail to be achieved. The Al content allowable in accordance with aspects of the present invention is 1.0% or less. The Al content is preferably 0.50% or less.

The balance of the composition of the steel sheet includes Fe and inevitable impurities. The composition of the steel sheet may optionally contain one or more elements selected from Cr: 0.005% to 2.0%, Mo: 0.005% to 2.0%, V: 0.005% to 2.0%, Ni: 0.005% to 2.0%, Cu: 0.005% to 2.0%, Nb: 0.005% to 0.20%, Ti: 0.005% to 0.20%, B: 0.0001% to 0.0050%, Ca: 0.0001% to 0.0050%, REM: 0.0001% to 0.0050%, Sb: 0.0010% to 0.10%, and Sn: 0.0010% to 0.50%.

Cr, Ni, and Cu are effective elements that cause the formation of martensite and carbide-containing bainite and thereby contribute to increase the strength of the steel sheet. In order to achieve the above advantageous effects, the content of each of the above elements is preferably set to be equal to or larger than the above lower limit. On the other hand, if any one of the contents of Cr, Ni, and Cu exceeds the above upper limit, retained austenite is likely to remain and resistance to sheared portion cracking may become degraded. The minimum Cr content is preferably 0.010% or more and is more preferably 0.050% or more. The maximum Cr content is preferably 1.0% or less and is more preferably 0.5% or less. The minimum Ni content is 0.010% or more and is more preferably 0.100% or more. The maximum Ni content is preferably 1.5% or less and is more preferably 1.0% or less. The minimum Cu content is preferably 0.010% or more and is more preferably 0.050% or more. The maximum Cu content is preferably 1.0% or less and is more preferably 0.5% or less.

Mo, V, Nb, and Ti are elements that cause the formation of carbides and effectively increase the strength of the steel sheet by precipitation strengthening. In order to achieve the above advantageous effects, the content of each of the above elements is preferably set to be equal to or larger than the above lower limit. If any one of the contents of Mo, V, Nb, and Ti exceeds the above upper limit, the size of carbide particles may be increased and, consequently, the resistance to sheared portion cracking required in accordance with aspects of the present invention may fail to be achieved. The minimum Mo content is preferably 0.010% or more and is more preferably 0.050% or more. The maximum Mo content is preferably 1.0% or less and is more preferably 0.5% or less. The minimum V content is preferably 0.010% or more and is more preferably 0.020% or more. The maximum V content is preferably 1.0% or less and is more preferably 0.3% or less. The minimum Nb content is preferably 0.007% or more and is more preferably 0.010% or more. The maximum Nb content is preferably 0.10% or less and is more preferably 0.05% or less. The minimum Ti content is preferably 0.007% or more and is more preferably 0.010% or more. The maximum Ti content is preferably 0.10% or less and is more preferably 0.05% or less.

B is an effective element that enhances the hardenability of the steel sheet, causes the formation of martensite and carbide-containing bainite, and thereby contributes to increases the strength of the steel sheet. In order to achieve the above advantageous effects, the B content is preferably set to 0.0001% or more, is more preferably set to 0.0004% or more, and is still more preferably set to 0.0006% or more. However, if the B content exceeds 0.0050%, the amount of inclusions may be increased and, consequently, resistance to sheared portion cracking may become degraded. The B content is more preferably 0.0030% or less and is still more preferably 0.0020% or less.

Ca and REM are elements that effectively enhance resistance to sheared portion cracking by controlling the morphology of inclusions. In order to achieve the above advantageous effects, the content of each of Ca and REM is preferably set to be equal to or larger than the lower limit. If the contents of Ca and REM exceed the respective upper limits above, the amount of inclusions may be increased and, consequently, the bendability of the steel sheet may become degraded. The minimum Ca content is preferably 0.0005% or more and is more preferably 0.0010% or more. The maximum Ca content is preferably 0.0040% or less and is more preferably 0.0020% or less. The minimum REM content is preferably 0.0005% or more and is more preferably 0.0010% or more. The maximum REM content is preferably 0.0040% or less and is more preferably 0.0020% or less.

Sn and Sb are elements that suppress the removal of nitrogen, boron, and the like and thereby effectively limit a reduction in the strength of steel. In order to achieve the above advantageous effects, the content of each of Sn and Sb is preferably set to be equal to or larger than the lower limit. If any one of the contents of Sn and Sb exceeds the respective upper limits, resistance to sheared portion cracking may become degraded. The minimum Sn content is preferably 0.0050% or more and is more preferably 0.0100% or more. The maximum Sn content is preferably 0.30% or less and is more preferably 0.10% or less. The minimum Sb content is preferably 0.0050% or more and is more preferably 0.0100% or more. The maximum Sb content is preferably 0.05% or less and is more preferably 0.03% or less.

Setting the contents of Cr, Mo, V, Ni, Cu, Nb, Ti, B, Ca, REM, Sn, and Sb to be less than the respective lower limits does not impair the advantageous effects according to aspects of the present invention. Therefore, when the contents of the above elements are less than the respective lower limits, it is considered that the composition of the steel sheet contains the above elements as inevitable impurities.

In accordance with aspects of the present invention, the composition of the steel sheet may contain inevitable impurity elements such as Zr, Mg, La, and Ce at a content of 0.002% or less in total. The composition of the steel sheet may also contain N at a content of 0.008% or less as an inevitable impurity.

The content of diffusible hydrogen in the base steel sheet of the high-strength galvanized steel sheet according to aspects of the present invention is described below. Galvanized steel sheets that include a galvanizing layer composed primarily of zinc usually include residual hydrogen, because hydrogen included in the atmosphere enters the base steel sheet during reduction annealing and becomes trapped due to the subsequent deposition of the galvanizing layer. Among the residual hydrogen, diffusible hydrogen significantly affects the propagation of cracks in the sheared edges; resistance to sheared portion cracking may become degraded significantly if the content of diffusible hydrogen exceeds 0.00008%. Although the mechanisms are not clear, it is considered that the hydrogen present in steel reduces the amount of energy required for the propagation of the cracks. Accordingly, the content of diffusible hydrogen in the base steel sheet is limited to be 0.00008% or less, is preferably 0.00006% or less, and is more preferably 0.00003% or less.

Among galvanized steel sheets that satisfy the above requirement concerning diffusible hydrogen content, a steel sheet in which desorption of the diffusible hydrogen peaks at 80° C. to 200° C. may have further high hole expandability. Although the mechanisms are not clear, it is considered that hydrogen that desorbs at less than 80° C. particularly facilitates the propagation of cracks in the shear edge.

The content of diffusible hydrogen in steel and the peak of desorption of diffusible hydrogen are measured by the following method. A specimen having a length of 30 mm and a width of 5 mm is taken from an annealed steel sheet. After the galvanizing layer has been removed from the specimen by grinding, the content of diffusible hydrogen in steel and the peak of desorption of diffusible hydrogen are measured. The above measurement is conducted by thermal desorption spectrometry. The rate of temperature rise is set to 200° C./hr. The hydrogen detected at 300° C. or less is considered as diffusible hydrogen.

The microstructure of the high-strength galvanized steel sheet according to aspects of the present invention is described below. The microstructure includes ferrite and carbide-free bainite, martensite and carbide-containing bainite, and retained austenite. The total area fraction of ferrite and carbide-free bainite is 0% to 65%. The total area fraction of martensite and carbide-containing bainite is 35% to 100%. The area fraction of retained austenite is 0% to 15%.

Total Area Fraction of Ferrite and Carbide-Free Bainite: 0% to 65%

The microstructure of the steel sheet includes ferrite and carbide-free bainite in appropriate amounts in order to enhance the ductility of the steel sheet. Here, if the total area fraction of ferrite and carbide-free bainite exceeds 65%, the desired strength of the steel sheet may fail to be achieved. Accordingly, the total area fraction of ferrite and carbide-free bainite is limited to be 0% to 65% and is preferably 0% to 50%, more preferably 0% to 30%, and still more preferably 0% to 15%. The lower limit for the total area fraction of ferrite and carbide-free bainite is preferably set to 1% or more. Carbide-free bainite refers to bainite in which the presence of carbide particles is not confirmed in an image captured by the following method: grinding a cross section of the steel sheet which is taken in the thickness direction so as to be parallel to the rolling direction, subsequently performing etching with 3% nital, and capturing an image of the cross section at a position ¼ from the surface in the thickness direction with a SEM (scanning electron microscope) at 1500-fold magnification. As illustrated in FIG. 1, carbide particles appear as white, dot-like or linear portions in the image and are distinguishable from island-like martensite and retained austenite, which are not dot-like or linear. In accordance with aspects of the present invention, grains having a minor axis of 100 nm or less are regarded as dot-like or linear. Examples of the carbide include iron-based carbides, such as cementite, Ti-based carbides, and Nb-based carbides. The above area fraction is determined by the method described in Examples below.

Total Area Fraction of Martensite and Carbide-Containing Bainite: 35% to 100%

Martensite and carbide-containing bainite are microstructure components necessary for achieving the TS required in accordance with aspects of the present invention. The above advantageous effects may be achieved when the total area fraction of martensite and carbide-containing bainite is 35% or more. Accordingly, the total area fraction of martensite and carbide-containing bainite is limited to be 35% to 100%. As for the lower limit, the total area fraction of martensite and carbide-containing bainite is preferably 50% or more, is more preferably 70% or more, and is most preferably 90% or more. As for the upper limit, the total area fraction of martensite and carbide-containing bainite is preferably 99% or less and is more preferably 98% or less. Carbide-containing bainite refers to bainite in which the presence of carbide particles is confirmed in an image captured by the following method: grinding a cross section of the steel sheet which is taken in the thickness direction so as to be parallel to the rolling direction, subsequently performing etching with 3% nital, and capturing an image of the cross section at a position ¼ from the surface in the thickness direction with a SEM (scanning electron microscope) at 1500-fold magnification. The above area fraction is determined by the method described in Examples below.

Area Fraction of Retained Austenite: 0% to 15%

The microstructure may include retained austenite in order to enhance ductility and the like such that the area fraction of retained austenite is 15% or less; if the area fraction of retained austenite exceeds 15%, resistance to sheared portion cracking may become degraded. Accordingly, the area fraction of retained austenite is limited to be 0% to 15% and is preferably 0% to 12%, more preferably 0% to 10%, and still more preferably 0% to 8%. The above area fraction is determined by the method described in Examples below.

Examples of phases other than the above phases are pearlite and the like, which may be included such that the area fraction of pearlite and the like is 10% or less. In other words, the area fraction of phases other than the above phases is preferably 10% or less.

The galvanizing layer is described below. In accordance with aspects of the present invention, the density of gaps that cut across the entire thickness of the galvanizing layer in a cross section of the galvanized steel sheet, the cross section being taken in the thickness direction so as to be perpendicular to the rolling direction is 10 gaps/mm or more.

If the above gap density is less than 10 gaps/mm, hydrogen may remain in the steel sheet and resistance to sheared edge cracking may become degraded. Accordingly, the density of gaps that cut across the entire thickness of the galvanizing layer in a cross section of the galvanized steel sheet, the cross section being taken in the thickness direction so as to be perpendicular to the rolling direction is limited to be 10 gaps/mm or more. The above gap density is preferably 100 gaps/mm or less, because the powdering property of the steel sheet may become degraded if the above gap density exceeds 100 gaps/mm. The term "gaps that cut across the entire thickness of the galvanizing layer" refers to gaps both ends of which reach the respective ends of the galvanizing layer in the thickness direction. The method for measuring the gap density is as described in Examples below.

The galvanizing layer is a layer formed by a common galvanizing method. Examples of the galvanizing layer also include an alloyed galvanizing layer produced by alloying the galvanizing layer. The composition of the galvanizing layer preferably contains 0.05% to 0.25% Al with the balance being zinc and inevitable impurities.

The tensile strength of the high-strength galvanized steel sheet according to aspects of the present invention is 1000 MPa or more and is preferably 1100 MPa or more. The maximum tensile strength is preferably, but is not limited to, 2200 MPa or less and is more preferably 2000 MPa or less in consideration of the balance between tensile strength and the other properties. The tensile strength of the high-strength galvanized steel sheet is measured by the method described in Examples below.

The high-strength galvanized steel sheet according to aspects of the present invention has excellent resistance to sheared portion cracking. Specifically, the average hole expansion (%) of the high-strength galvanized steel sheet measured and calculated by the method described in Examples below is 25% or more and is more preferably 30% or more. The upper limit for the average hole expansion (%) is preferably, but is not limited to, 70% or less and is more preferably 50% or less in consideration of balance between the resistance to sheared portion cracking and the other properties.

<Method for Producing High-Strength Galvanized Steel Sheet>

The method for producing the high-strength galvanized steel sheet according to aspects of the present invention includes an annealing step, a galvanizing step, a bending-unbending step, a retention step, and a final cooling step. Note that, the temperature of the surface of the steel sheet is used as the temperature of the steel sheet.

The annealing step is a step in which a hot-rolled or cold-rolled steel sheet is subjected to heating to an annealing temperature of 750° C. or more and subsequently subjected to cooling such that the average cooling rate in the range of 550° C. to 700° C. is 3° C./s or more. The amount of retention time during which the steel sheet is held in a temperature range of 750° C. or more in the above heating and the cooling is 30 seconds or more.

The method for preparing the hot-rolled or cold-rolled steel sheet, which serves as a starting material, is not particularly limited. The slab used for preparing the hot-rolled or cold-rolled steel sheet is preferably produced by continuous casting in order to prevent macrosegregation. Ingot casting and thin-slab casting may alternatively be used for preparing the slab. When the slab is hot-rolled, the slab may be cooled to room temperature and subsequently reheated prior to the hot rolling. In another case, the slab may be charged into a heating furnace to perform hot rolling without being cooled to room temperature. Alternatively, an energy-saving process in which the slab is hot-rolled immediately after slight heat retention may also be used. When the slab is heated, it is preferable to heat the slab to 1100° C. or more in order to dissolve carbide and prevent an increase in the rolling load. The slab-heating temperature is preferably set to 1300° C. or less in order to prevent an increase in scale loss. The slab-heating temperature is determined on the basis of the temperature of the surface of the slab. In hot-rolling of the slab, rough-rolled steel bars may be heated. Further, rough-rolled steel bars may be joined to one another and may be subjected to finish rolling continuously. So called, "continuous rolling process" may be used. The finish rolling is preferably performed with a finishing temperature equal to or higher than the Ara transformation temperature because finish rolling may otherwise increase anisotropy and thereby degrade the workability of the cold-rolled and annealed steel sheet. It is preferable to perform lubricated rolling with a coefficient of friction of 0.10 to 0.25 in all or a part of the passes of the finish rolling in order to reduce the rolling load and variations in shape and quality of the steel sheet. Subsequent to the hot rolling, the steel sheet is coiled and scale is removed from the steel sheet by pickling or the like. Subsequently, a heat treatment and cold rolling may be performed as needed.

The heating temperature (annealing temperature) is set to 750° C. or more. If the annealing temperature is less than 750° C., the formation of austenite may become insufficient. Since austenite formed by annealing is converted into martensite or bainite (both carbide-containing bainite and carbide-free bainite) in the final microstructure by bainite transformation or martensite transformation, insufficient formation of austenite results in failure to produce a steel sheet having the desired microstructure. Accordingly, the annealing temperature is limited to be 750° C. or more. The maximum annealing temperature is preferably, but is not limited to, 950° C. or less in consideration of ease of operation and the like.

In the above annealing step, the $H_2$ concentration at the annealing temperature is preferably set to 30% (volume %) or less. In such a case, the amount of hydrogen that enters the steel sheet may be further reduced and, consequently, resistance to sheared portion cracking may be further enhanced. The $H_2$ concentration at the annealing temperature is more preferably set to 20% or less.

The average cooling rate in the range of 550° C. to 700° C. is limited to be 3° C./s or more. If the average cooling rate in the range of 550° C. to 700° C. is less than 3° C./s, a large amount of ferrite and carbide-free bainite may be formed and, consequently, the desired microstructure may fail to be formed. Accordingly, the average cooling rate in the range of 550° C. to 700° C. is limited to be 3° C./s or more. The maximum average cooling rate is not limited but preferably 500° C./s or less in consideration of ease of operation and the like.

It is preferable to set the $H_2$ concentration in the cooling performed in the temperature range of 550° C. to 700° C. to be 30% (volume %) or less. In the case where the above condition is satisfied, the amount of diffusible hydrogen that desorbs at low temperatures may be reduced and, consequently, resistance to sheared portion cracking may be further enhanced. The $H_2$ concentration in the cooling performed in the temperature range of 550° C. to 700° C. is more preferably set to 20% or less.

The temperature at which the cooling is stopped, that is, the cooling stop temperature, is not particularly limited but preferably 350° C. to 550° C. because the steel microstructure needs to include austenite after the steel sheet has been galvanized or alloyed.

The amount of retention time during which the steel sheet is held in a temperature range of 750° C. or more in the heating and the cooling is 30 seconds or more. If the amount of retention time is less than 30 seconds, the formation of austenite may become insufficient and, consequently, the above steel sheet may fail to have the desired microstructure. Accordingly the retention time is limited to be 30 seconds or more. The maximum retention time is not particularly limited but preferably 1000 seconds or less in consideration of ease of operation and the like.

Subsequent to the cooling, reheating may be optionally performed such that the steel sheet is held in the temperature range of heating temperature Ms to 600° C. for 1 to 100 seconds. In the case where the reheating is not performed, the steel sheet may be held at the cooling stop temperature. The amount of holding time during which the steel sheet is held at the cooling stop temperature is preferably 250 seconds or less and is more preferably 200 seconds or less. The minimum holding time is preferably 10 seconds or more and is more preferably 15 seconds or more.

Although condition on the temperature at which the steel sheet is held until the galvanizing layer is deposited on the steel sheet and the amount of time during which the steel sheet is held until the galvanizing layer, is deposited on the steel sheet are not limited, the temperature at which the steel sheet is held until the galvanizing layer is deposited on the steel sheet is preferably 350° C. or more, because the microstructure of the steel sheet needs to include austenite after the steel sheet has been galvanized or alloyed.

The galvanizing step is a step in which, subsequent to the annealing step, the annealed steel sheet is galvanized and subsequently alloyed as needed. For example, a galvanizing layer containing, by mass, Fe: 0% to 20.0%, Al: 0.001% to 1.0%, and one or more elements selected from Pb, Sb, Si, Sn, Mg, Mn, Ni, Cr, Co, Ca, Cu, Li, Ti, Be, Bi, and REM: 0% to 30% in total, with the balance being Zn and inevitable impurities is formed on the surface of the annealed steel sheet after the steel sheet has been cooled.

The method for performing the galvanizing treatment is not particularly limited; common galvanizing methods, such as hot-dip galvanizing and electrogalvanizing, may be used. The conditions under which the galvanizing treatment is performed may be set appropriately. Subsequent to the hot-dip galvanizing of the steel sheet, the steel sheet may be heated in order to perform an alloying treatment. The heating temperature at which the alloying treatment is performed is preferably, but not limited to, 460° C. to 600° C.

The bending-unbending step is a step in which the galvanized steel sheet is bent and unbent in a direction perpendicular to the rolling direction at a bend radius of 500 to 1000 mm in the temperature range of Ms to Ms−200° C. during cooling performed subsequent to the galvanizing step. Each of the bending and the unbending is performed once or more.

Gaps that extend across the entire thickness of the galvanizing layer (i.e., gaps that cut across the entire thickness of the galvanizing layer) are formed during cooling performed subsequent to the galvanizing of the steel sheet or galvanizing and alloying of the steel sheet in order to reduce the residual stress resulting from the difference in expansion coefficient between the galvanizing layer and the base steel sheet. In the case where the composition of the steel sheet contains austenite, the steel sheet becomes swollen as a result of martensite transformation when the temperature is equal to or lower than the Ms point and, consequently, the manner in which the gaps are formed in the galvanizing layer can be adjusted. The manner in which the gaps are formed in the galvanizing layer can also be adjusted by controlling the tensile stress applied to the surface when the steel sheet is bent. Performing the above adjusting within the above range, that is, bending and unbending the steel sheet at a bend radius of 500 to 1000 mm in the temperature range of Ms to Ms−200° C., each of the bending and the unbending being repeated once or more (preferably 2 to 10 times), enables the gap density in the galvanizing layer included in the high-strength galvanized steel sheet to be adjusted to be within the desired range. The bend angle is preferably in the range of 60° to 180°. In the case that any of the above temperature range, the above bend radius, and the above number of time the steel sheet is bent and unbent deviates from the specified range, the desired gap density may fail to be achieved and, accordingly, the amount of hydrogen that desorbs in the subsequent cooling step may be reduced. In such a case, resistance to sheared portion cracking may become degraded. The bending and unbending of the steel sheet needs to be performed over the entirety of the steel sheet. It is preferable to bend and unbend the steel sheet while the steel sheet is transported with rollers such that the entirety of the steel sheet is bent and unbent with the rollers. The Ms point is the temperature at which martensite transformation starts and is determined with Formaster.

The retention step is a step in which holding is performed subsequent to the bending-unbending step for 3 s or more until the temperature reaches 100° C.

When holding is performed subsequent to the bending and unbending for 3 s or more until the temperature reaches 100° C., hydrogen desorbs through the gaps formed in the galvanizing layer as a result of the bending and unbending and, consequently, excellent resistance to sheared portion cracking may be achieved. Note that, the bending and unbending refers to the first bending and unbending performed when the temperature is equal to or lower than the Ms point.

The final cooling step is a step in which the steel sheet is cooled to 50° C. or less after the above retention step. It is necessary to cool the steel sheet to 50° C. or less in order to perform oiling and the like subsequently. The cooling rate at which the steel sheet is cooled is not limited but normally set such that an average cooling rate of 1 to 100° C./s is achieved.

Subsequent to the cooling, temper rolling and another bending-unbending treatment may be optionally performed.

EXAMPLES

Steels having the compositions described in Table 1 were prepared in a converter and subsequently formed into slabs by continuous casting. The slabs were heated to 1200° C. and then subjected to rough rolling and finish rolling. Hereby, hot-rolled steel sheets having a thickness of 3.0 mm were prepared. In the hot-rolling process the finish rolling temperature was 900° C. and the coiling temperature was 500° C. After the hot-rolled steel sheets had been pickled, the steel sheets were cold-rolled to a thickness of 1.4 mm. The cold-rolled steel sheets were annealed. The annealing of the steel sheets was performed using a continuous hot-dip galvanizing line under the conditions described in Table 2. Hereby, hot-dip galvanized and alloyed hot-dip galvanized steel sheets 1 to 38 were prepared. The galvanized steel sheets (GI) were prepared by dipping the annealed steel sheets in a plating bath having a temperature of 460° C. and depositing a galvanizing layer on each of the steel sheets in an amount of 35 to 45 g/m$^2$. The alloyed galvanized steel sheets (GA) were prepared by subjecting the galvanized steel sheets to an alloying treatment in which the galvanized steel sheets were held at 460° C. to 600° C. for 1 to 60 s. The galvanized steel sheets were bent and unbent under the conditions described in Table 2. When the steel sheets were bent and unbent, rollers were used such that the entirety of each of the steel sheets was bent and unbent. Subsequent to the bending-unbending step, a retention step was conducted under the conditions described in Table 2. Then, the temperature was reduced to 50° C. or less. Each of the steel sheets were evaluated in terms of microstructure, tensile properties, diffusible hydrogen content, hydrogen desorption peak temperature, and resistance to sheared portion cracking by the following test methods.

Microstructure Observation (Phase Area Fractions)

The term "area fraction" of ferrite, martensite, or bainite refers to the ratio of the area of the microstructure component to the area of observation. The above area fractions were determined by the following method: taking a sample from each of the annealed steel sheets; grinding a cross section of the sample which was taken in the thickness direction so as to be parallel to the rolling direction; performing etching with 3% nital; capturing an image of the cross section at a position ¼ from the surface in the thickness direction with a SEM (scanning electron microscope) at 1500-fold, magnification in 3 fields of view; determining the area fractions of the microstructure components with Image-Pro produced by Media Cybernetics, Inc. on the basis of the image data; and calculating the average of the area fractions of each of the microstructure components in the three fields of view as the area fraction of the microstructure component. In the image data, the microstructure components can be distinguished from one another since ferrite appears black, martensite and retained austenite appear white or light gray, and bainite appears black or dark gray that includes aligned carbide particles, island-like martensite, or both aligned carbide particles and island-like martensite (it is possible to distinguish carbide-free bainite and carbide-containing bainite from each other since the grain boundary of bainite can be determined; island-like martensite is the portions of the image which appear white or light gray as illustrated in FIG. 1). In accordance with aspects of the present invention, the area fraction of bainite is the area fraction of the black or dark gray portion excluding the white or light gray portion included in bainite. The area fraction of martensite was determined by subtracting the area fraction of retained austenite (the volume fraction of retained austenite was regarded as area fraction) described below from the area fraction of the white or light gray microstructure component. In accordance with aspects of the present invention, martensite may be carbide-containing auto-tempered martensite or tempered-martensite. In the carbide-containing martensite, carbide particles are not aligned in a specific direction unlike bainite. The island-like martensite is martensite having any of the above characteristics. In accordance with aspects of the present invention, white portions that do not have a dot-like or linear shape were distinguished as the above martensite or retained austenite. Although pearlite is not always included in the steel sheet according to aspects of the present invention, pearlite can be distinguished as a black and white, lamellar microstructure.

The volume fraction of retained austenite was determined by the following method: grinding each of the annealed steel sheets to a depth ¼ the thickness of the steel sheet; further polishing the resulting cross section 0.1 mm by chemical polishing; measuring the integrated reflection intensities on the (200), (220), and (311) planes of fcc iron (austenite) and the (200), (211), and (220) planes of bcc iron (ferrite) with an X-ray diffraction apparatus using Mo-Kα radiation; and determining the volume fraction of retained austenite on the basis of the ratio of the integrated reflection intensities measured on the above planes of fcc iron to the integrated reflection intensities measured on the above planes of bcc iron. The volume fraction of retained austenite was regarded as the area fraction of retained austenite.

In the table, "V(F+B1)" denotes the total area fraction of ferrite and carbide-free bainite; "V(M+B2)" denotes the total area fraction of martensite and carbide-containing bainite; "V(y)" denotes the area fraction of retained austenite; and "Others" denotes the area fraction of the other phases.

Microstructure Observation (Gap Density)

Figure 2:
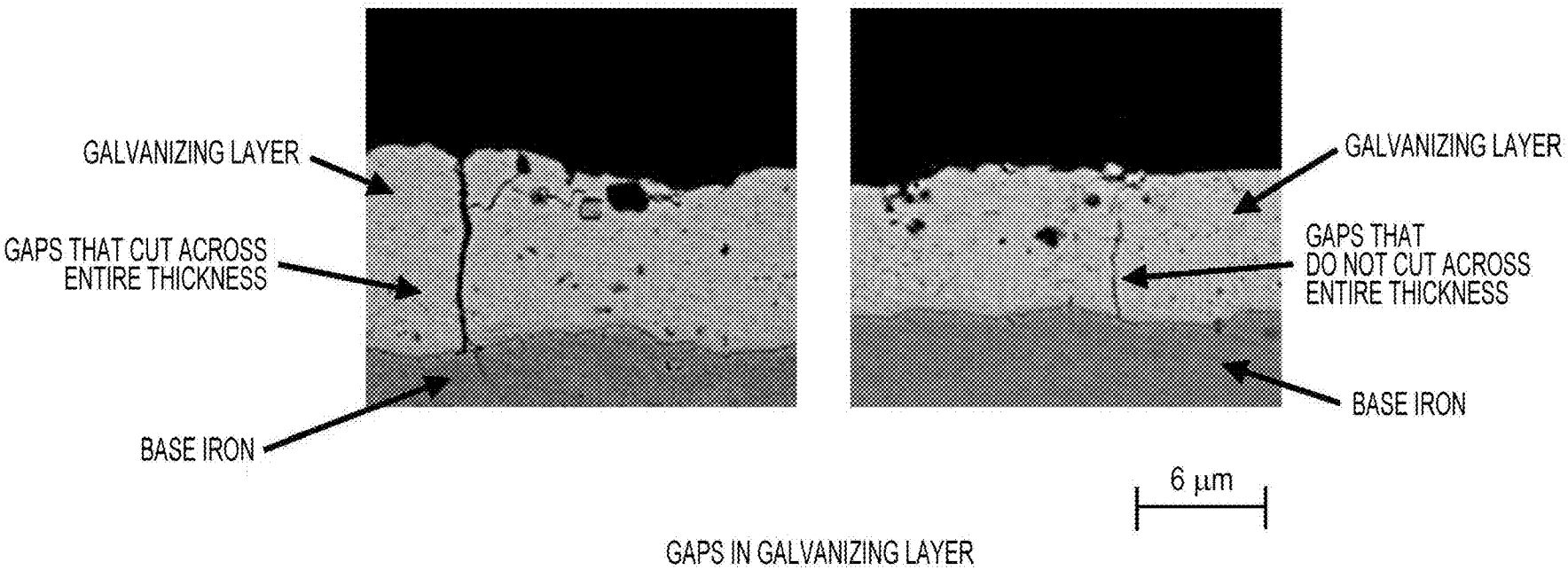
FIG. 2 includes example images illustrating gaps formed in a galvanizing layer.

An image that covered a region that was in the vicinity of the surface layer was captured with an SEM at 3000-fold magnification in 30 fields of view. The gap density was determined by dividing the number of gaps that were present in the fields of view and cut across the entire thickness of the galvanizing layer by the total length of the surfaces of the steel sheet which were observed in the fields of view. An evaluation of "Passed" was given when the gap density was 10 gaps/mm or more. FIG. 2 illustrates an example of the images.

Content of Diffusible Hydrogen in Steel and Peak of Desorption of Diffusible Hydrogen A specimen having a length of 30 mm and a width of 5 mm was taken from each of the annealed steel sheets. After the galvanizing layer had been removed from the specimen by grinding, the content of diffusible hydrogen in steel and the peak of desorption of diffusible hydrogen were measured. The above measurement was conducted by thermal desorption spectrometry. The rate of temperature rise was set to 200° C./hr. The hydrogen detected at 300° C. or less was considered as diffusible hydrogen. Table 3 summarizes the results.

Tensile Test

A JIS No. 5 tensile test specimen (JISZ 2201) was taken from each of the annealed steel sheets along a direction perpendicular to the rolling direction. The specimen was subjected to a tensile test conforming to JIS Z 2241 with a strain rate of $10^{-3}$/s in order to determine the TS of the steel sheet. In accordance with aspects of the present invention, an evaluation of "Passed" was given when a TS of 1000 MPa or more was achieved.

Resistance to Sheared Portion Cracking

The resistance to sheared portion cracking of each of the steel sheets was evaluated by a hole expansion test. A specimen having a length of 100 mm and a width of 100 mm was taken from each of the annealed steel sheets. The specimen was subjected to a hole expansion test basically in accordance with JFST 1001 (The Japan Iron and Steel Federation Standard) three times. The average hole expansion (%) of the steel sheet was determined. Thereby, resistance to sheared portion cracking was evaluated. Note that, in the evaluation, the clearance was set to 9% and a number of shear planes were created in an edge of the steel sheet. In accordance with aspects of the present invention, an evaluation of "Passed" was given when the average hole expansion was 25% or more.

Table 3 summarizes the results.

TABLE 1

| | Composition (mass %) | | | | | | | | |
|---|---|---|---|---|---|---|---|---|---|
| Steel | C | Si | Mn | P | S | Al | N | Others | Remark |
| A | 0.10 | 1.00 | 3.5 | 0.015 | 0.002 | 0.030 | 0.003 | — | Within the scope of invention |
| B | 0.15 | 0.50 | 3.0 | 0.015 | 0.002 | 0.030 | 0.003 | — | Within the scope of invention |
| C | 0.20 | 1.50 | 2.5 | 0.015 | 0.002 | 0.030 | 0.003 | — | Within the scope of invention |
| D | 0.25 | 0.50 | 2.5 | 0.015 | 0.002 | 0.030 | 0.003 | Cr: 0.1, Nb: 0.01, Ti: 0.02, B: 0.0010 | Within the scope of invention |
| E | 0.30 | 0.10 | 2.0 | 0.015 | 0.002 | 0.030 | 0.003 | Ti: 0.02, Mo: 0.1, B: 0.0010, Sb: 0.01 | Within the scope of invention |
| F | 0.18 | 1.00 | 2.5 | 0.015 | 0.002 | 0.030 | 0.003 | Ni: 0.5, Cr: 0.5 | Within the scope of invention |
| G | 0.15 | 0.10 | 3.0 | 0.015 | 0.002 | 0.030 | 0.003 | Mo: 0.1, V: 0.03, Cu: 0.2, Ca: 0.0020 | Within the scope of invention |
| H | 0.15 | 0.20 | 2.5 | 0.015 | 0.002 | 0.030 | 0.003 | Cr: 0.2, Nb: 0.03, Ti: 0.02, B: 0.0010 | Within the scope of invention |
| 1 | 0.15 | 1.00 | 3.0 | 0.015 | 0.002 | 0.030 | 0.003 | Nb: 0.01, Ti: 0.02, B: 0.0020, Sb: 0.01 | Within the scope of invention |
| J | 0.15 | 1.00 | 2.5 | 0.015 | 0.002 | 0.030 | 0.003 | Mo: 0.2, Sn: 0.05, REM: 0.002 | Within the scope of invention |
| K | 0.04 | 1.00 | 2.5 | 0.015 | 0.002 | 0.030 | 0.003 | Ti: 0.02, Mo: 0.2, B: 0.0020 | Outside the scope of invention |
| L | 0.33 | 0.50 | 3.0 | 0.015 | 0.002 | 0.030 | 0.003 | Ti: 0.02, B: 0.0020 | Outside the scope of invention |
| M | 0.20 | 3.10 | 2.5 | 0.015 | 0.002 | 0.030 | 0.003 | Ni: 0.2, Ti: 0.03, V: 0.10, REM: 0.002 | Outside the scope of invention |
| N | 0.15 | 0.50 | 1.4 | 0.015 | 0.002 | 0.030 | 0.003 | Mo: 0.2, V: 0.1, Cu: 0.2, Ca: 0.0010 | Outside the scope of invention |
| O | 0.15 | 1.00 | 4.5 | 0.015 | 0.002 | 0.030 | 0.003 | | Outside the scope of invention |
| P | 0.20 | 0.50 | 2.6 | 0.015 | 0.002 | 1.500 | 0.003 | Mo: 0.2, B: 0.0020 | Outside the scope of invention |

*The underlined values are out of the scope of the present invention.

TABLE 2

| Steel sheet No. | Steel | Cold rolling | Conditions: Annealing temperature (° C.) | H2 concentration at annealing temperature (%) | Retention time (s)*1 | Cooling stop temperature (° C.) | Average cooling rate at 550° C. to 700° C. (° C./s) | H2 concentration at 550° C. to 700° C. (%) | Reheating temperature (° C.) | Holding time (s)*2 |
|---|---|---|---|---|---|---|---|---|---|---|
| 1 | A | Yes | 800 | 15 | 150 | 500 | 10 | 15 | — | 200 |
| 2 | | | 730 | 15 | 150 | 500 | 10 | 15 | — | 200 |
| 3 | | | 800 | 15 | 25 | 500 | 60 | 15 | — | 33 |
| 4 | | | 800 | 15 | 750 | 550 | 2 | 15 | — | 250 |
| 5 | B | Yes | 810 | 15 | 60 | 500 | 10 | 15 | — | 80 |
| 6 | | | 810 | 15 | 40 | 500 | 15 | 15 | — | 53 |
| 7 | | | 810 | 15 | 200 | 500 | 4 | 15 | — | 267 |
| 8 | | | 810 | 15 | 480 | 500 | 3 | 15 | — | 160 |
| 9 | C | No | 830 | 15 | 300 | 350 | 4 | 15 | 400 | 400 |
| 10 | D | Yes | 850 | 15 | 120 | 500 | 12 | 15 | — | 15 |
| 11 | | | 850 | 15 | 120 | 500 | 12 | 15 | — | 15 |
| 12 | | | 850 | 15 | 120 | 500 | 12 | 15 | — | 15 |
| 13 | E | Yes | 850 | 15 | 120 | 500 | 12 | 15 | — | 40 |
| 14 | | | 850 | 15 | 120 | 500 | 12 | 15 | — | 40 |
| 15 | F | Yes | 850 | 15 | 150 | 500 | 12 | 16 | — | 50 |
| 16 | | | 850 | 15 | 150 | 500 | 12 | 42 | — | 50 |
| 17 | | | 850 | 15 | 150 | 500 | 12 | 29 | — | 50 |
| 18 | | | 850 | 15 | 150 | 500 | 12 | 32 | — | 50 |
| 19 | | | 850 | 15 | 150 | 500 | 12 | 28 | — | 50 |
| 20 | | | 850 | 15 | 150 | 500 | 12 | 4 | — | 50 |
| 21 | | | 850 | 15 | 150 | 500 | 12 | 21 | — | 50 |
| 22 | G | Yes | 780 | 15 | 120 | 500 | 12 | 15 | — | 40 |
| 23 | H | Yes | 860 | 35 | 120 | 500 | 12 | 15 | — | 40 |
| 24 | | | 860 | 28 | 120 | 500 | 12 | 15 | — | 40 |
| 25 | | | 860 | 21 | 120 | 500 | 12 | 15 | — | 40 |
| 26 | I | Yes | 860 | 5 | 60 | 500 | 10 | 15 | — | 20 |
| 27 | | | 860 | 13 | 60 | 500 | 10 | 15 | — | 20 |
| 28 | | | 860 | 18 | 60 | 500 | 10 | 15 | — | 20 |
| 29 | J | Yes | 880 | 24 | 60 | 500 | 10 | 15 | — | 20 |
| 30 | | | 880 | 39 | 60 | 500 | 10 | 15 | — | 20 |
| 31 | | | 880 | 30 | 60 | 500 | 10 | 15 | — | 20 |
| 32 | K | Yes | 810 | 15 | 120 | 500 | 12 | 15 | — | 40 |
| 33 | L | Yes | 800 | 15 | 120 | 500 | 12 | 15 | — | 40 |
| 34 | M | Yes | 900 | 15 | 120 | 500 | 12 | 15 | — | 40 |
| 35 | N | Yes | 810 | 15 | 120 | 500 | 12 | 15 | — | 40 |
| 36 | O | Yes | 810 | 15 | 120 | 500 | 12 | 15 | — | 40 |
| 37 | P | Yes | 790 | 15 | 120 | 500 | 12 | 15 | — | 40 |
| 38 | F | Yes | 850 | 15 | 150 | 500 | 12 | 46 | — | 40 |

| Steel sheet No. | Conditions: Ms point (° C.) | Bend-unbend temperature (° C.) | Retention time to 100° C. after bending and unbending (s) | Ms point − 200 (° C.) | Bend radius (mm) | Number of times steel sheet was bent (times) | Number of times steel sheet was unbent (times) | Galvanizing conditions | Remark |
|---|---|---|---|---|---|---|---|---|---|
| 1 | 323 | 300 | 8 | 123 | 800 | 3 | 3 | GA | Invention example |
| 2 | 233 | 150 | 3 | 33 | 800 | 3 | 3 | GA | Comparative example |
| 3 | 301 | 250 | 3 | 101 | 800 | 2 | 2 | GA | Comparative example |
| 4 | 304 | 200 | 20 | 104 | 800 | 3 | 3 | GA | Comparative example |
| 5 | 358 | 300 | 3 | 158 | 800 | 2 | 2 | GI | Invention example |
| 6 | 356 | 380 | 3 | 156 | 800 | 2 | 2 | GI | Comparative example |
| 7 | 355 | 150 | 3 | 155 | 800 | 2 | 2 | GI | Comparative example |
| 8 | 356 | 300 | 26 | 156 | 1250 | 3 | 3 | GI | Comparative example |
| 9 | 279 | 200 | 8 | 79 | 800 | 2 | 2 | GA | Invention example |
| 10 | 361 | 250 | 5 | 161 | 800 | 3 | 3 | GA | Invention example |
| 11 | 361 | 250 | 5 | 161 | 400 | 3 | 3 | GA | Comparative example |
| 12 | 361 | 250 | 2 | 161 | 800 | 3 | 3 | GA | Comparative example |
| 13 | 364 | 300 | 6 | 164 | 800 | 2 | 2 | GA | Invention example |
| 14 | 364 | 300 | 6 | 164 | 800 | 2 | 2 | GA | Invention example |
| 15 | 386 | 300 | 8 | 186 | 800 | 4 | 4 | GA | Invention example |
| 16 | 386 | 300 | 8 | 186 | 800 | 4 | 4 | GA | Invention example |
| 17 | 386 | 300 | 8 | 186 | 800 | 4 | 4 | GA | Invention example |
| 18 | 386 | 300 | 8 | 186 | 800 | 4 | 4 | GA | Invention example |
| 19 | 386 | 300 | 8 | 186 | 800 | 4 | 4 | GA | Invention example |
| 20 | 386 | 300 | 8 | 186 | 800 | 4 | 4 | GA | Invention example |
| 21 | 387 | 300 | 8 | 187 | 800 | 4 | 4 | GA | Invention example |
| 22 | 365 | 300 | 6 | 165 | 800 | 2 | 2 | GA | Invention example |
| 23 | 398 | 300 | 6 | 198 | 800 | 2 | 2 | GA | Invention example |
| 24 | 398 | 300 | 6 | 198 | 800 | 2 | 2 | GA | Invention example |
| 25 | 398 | 300 | 6 | 198 | 800 | 2 | 2 | GA | Invention example |

TABLE 2-continued

| | | | | | | | | | |
|---|---|---|---|---|---|---|---|---|---|
| 26 | 379 | 300 | 3 | 179 | 800 | 2 | 2 | GA | Invention example |
| 27 | 379 | 300 | 3 | 179 | 800 | 2 | 2 | GA | Invention example |
| 28 | 379 | 300 | 3 | 179 | 800 | 2 | 2 | GA | Invention example |
| 29 | 398 | 300 | 3 | 198 | 800 | 2 | 2 | GA | Invention example |
| 30 | 398 | 300 | 3 | 198 | 800 | 2 | 2 | GA | Invention example |
| 31 | 398 | 300 | 3 | 198 | 800 | 2 | 2 | GA | Invention example |
| 32 | 401 | 300 | 6 | 201 | 800 | 2 | 2 | GA | Comparative example |
| 33 | 314 | 300 | 6 | 114 | 800 | 2 | 2 | GA | Comparative example |
| 34 | 379 | 300 | 6 | 179 | 800 | 2 | 2 | GA | Comparative example |
| 35 | 315 | 300 | 6 | 115 | 800 | 2 | 2 | GA | Comparative example |
| 36 | 320 | 300 | 6 | 120 | 800 | 2 | 2 | GA | Comparative example |
| 37 | 263 | 200 | 6 | 63 | 800 | 2 | 2 | GA | Comparative example |
| 38 | 386 | 200 | 6 | 186 | 800 | 6 | 6 | GA | Invention example |

*The underlined values are out of the scope of the present invention.
*1Retention time in temperature range of 750° C. or more
*2Holding time at cooling stop temperature or in reheating

TABLE 3

| | Microstructure | | | | Galvanizing layer | Hydrogen content in steel | Hydrogen desorption peak | Mechanical properties | | |
|---|---|---|---|---|---|---|---|---|---|---|
| Steel No. | V (F + B1) (%) | V (M + B2) (%) | V (γ) (%) | Others (%) | Density of gaps (gaps/mm) | (%) $\times 10^{-4}$ | temperature (° C.) | TS (MPa) | λ' (%) | Remark |
| 1 | 60 | 38 | 1 | 1 | 12 | 0.50 | 110 | 1039 | 34 | Invention example |
| 2 | 80 | 15 | 5 | 0 | 10 | 0.52 | 120 | 798 | 31 | Comparative example |
| 3 | 68 | 31 | 1 | 0 | 11 | 0.42 | 110 | 955 | 32 | Comparative example |
| 4 | 67 | 30 | 2 | 1 | 10 | 0.39 | 120 | 958 | 30 | Comparative example |
| 5 | 28 | 71 | 1 | 0 | 22 | 0.48 | 130 | 1330 | 33 | Invention example |
| 6 | 30 | 69 | 1 | 0 | 9 | 1.02 | 120 | 1327 | 15 | Comparative example |
| 7 | 31 | 68 | 1 | 0 | 9 | 0.93 | 120 | 1325 | 16 | Comparative example |
| 8 | 30 | 68 | 2 | 0 | 8 | 0.90 | 130 | 1330 | 17 | Comparative example |
| 9 | 32 | 58 | 10 | 0 | 19 | 0.20 | 150 | 1392 | 44 | Invention example |
| 10 | 1 | 96 | 3 | 0 | 13 | 0.50 | 140 | 1774 | 32 | Invention example |
| 11 | 1 | 96 | 3 | 0 | 9 | 0.98 | 140 | 1774 | 11 | Comparative example |
| 12 | 1 | 96 | 3 | 0 | 13 | 0.87 | 130 | 1769 | 15 | Comparative example |
| 13 | 0 | 93 | 7 | 0 | 19 | 0.41 | 110 | 1995 | 35 | Invention example |
| 14 | 0 | 93 | 7 | 0 | 17 | 0.40 | 110 | 1993 | 35 | Invention example |
| 15 | 2 | 93 | 5 | 0 | 14 | 0.28 | 110 | 1539 | 46 | Invention example |
| 16 | 2 | 93 | 5 | 0 | 11 | 0.51 | 50 | 1545 | 26 | Invention example |
| 17 | 2 | 94 | 4 | 0 | 13 | 0.30 | 92 | 1540 | 41 | Invention example |
| 18 | 2 | 94 | 4 | 0 | 12 | 0.59 | 76 | 1540 | 29 | Invention example |
| 19 | 2 | 94 | 4 | 0 | 11 | 0.31 | 98 | 1540 | 42 | Invention example |
| 20 | 2 | 94 | 4 | 0 | 12 | 0.20 | 150 | 1540 | 47 | Invention example |
| 21 | 1 | 95 | 4 | 0 | 11 | 0.27 | 100 | 1549 | 42 | Invention example |
| 22 | 20 | 78 | 2 | 0 | 16 | 0.37 | 110 | 1362 | 35 | Invention example |
| 23 | 0 | 98 | 2 | 0 | 16 | 0.77 | 110 | 1372 | 27 | Invention example |
| 24 | 1 | 97 | 2 | 0 | 16 | 0.32 | 120 | 1370 | 36 | Invention example |
| 25 | 0 | 98 | 2 | 0 | 15 | 0.39 | 120 | 1366 | 36 | Invention example |
| 26 | 0 | 97 | 3 | 0 | 22 | 0.11 | 110 | 1420 | 48 | Invention example |
| 27 | 0 | 96 | 4 | 0 | 22 | 0.29 | 120 | 1422 | 47 | Invention example |
| 28 | 0 | 97 | 3 | 0 | 23 | 0.18 | 120 | 1424 | 44 | Invention example |
| 29 | 0 | 99 | 1 | 0 | 28 | 0.35 | 110 | 1435 | 35 | Invention example |
| 30 | 0 | 97 | 3 | 0 | 29 | 0.80 | 110 | 1430 | 26 | Invention example |
| 31 | 0 | 98 | 2 | 0 | 30 | 0.62 | 110 | 1442 | 33 | Invention example |
| 32 | 72 | 27 | 1 | 0 | 8 | 0.28 | 110 | 771 | 55 | Comparative example |
| 33 | 0 | 94 | 6 | 0 | 13 | 0.42 | 120 | 2162 | 24 | Comparative example |
| 34 | 2 | 91 | 7 | 0 | 14 | 0.47 | 110 | 1783 | 7 | Comparative example |
| 35 | 70 | 25 | 3 | 2 | 11 | 0.36 | 110 | 834 | 31 | Comparative example |
| 36 | 0 | 92 | 8 | 0 | 15 | 0.27 | 120 | 1551 | 23 | Comparative example |
| 37 | 61 | 34 | 5 | 0 | 12 | 0.33 | 120 | 993 | 34 | Comparative example |
| 38 | 2 | 94 | 4 | 0 | 15 | 0.52 | 46 | 1536 | 25 | Invention example |

*The underlined values are out of the scope of the present invention.
"λ': Average hole expansion The steel sheets prepared in Invention examples were high-strength steel sheets having excellent resistance to sheared portion cracking. In contrast, the steel sheets prepared in Comparative examples, which were out of the scope of the present invention, did not achieve the desired strength or the desired resistance to sheared portion cracking.

INDUSTRIAL APPLICABILITY

According to aspects of the present invention, a high-strength galvanized steel sheet having a TS of 1000 MPa or more and excellent resistance to sheared portion cracking may be produced. Using the high-strength member and the high-strength steel sheet according to aspects of the present invention for producing automotive components may markedly improve the collision safety and the fuel economy of automobiles.

The invention claimed is:

1. A high-strength galvanized steel sheet comprising:

a base steel sheet having a composition containing, by mass,

C: 0.05% to 0.30%,

Si: 3.0% less,

Mn: 1.5% to 4.0%,

P: 0.100% or less,

S: 0.02% or less, and

Al: 1.0% or less, with the balance being Fe and inevitable impurities, wherein the composition further containing two or more elements selected from, by mass, Cr: 0.005% to 2.0%, Mo: 0.005% to 2.0%, V: 0.005% to 2.0%, Ni: 0.005% to 2.0%, Cu: 0.005% to 2.0%, Nb: 0.005% to 0.20%, Ti: 0.005% to 0.20%, B: 0.0001% to 0.0050%, Ca: 0.0001% to 0.0050%, REM: 0.0001% to 0.0050%, Sb: 0.0010% to 0.10%, and Sn: 0.0010% to 0.50%, the base steel sheet having a microstructure including one or more of ferrite, carbide-free bainite, martensite, carbide-containing bainite, and retained austenite, a total area fraction of ferrite and carbide-free bainite being 0% to 65%, a total area fraction of martensite and carbide-containing bainite being 35% to 100%, and an area fraction of retained austenite being 0% to 15%, a content of diffusible hydrogen in the base steel sheet being a 0.00008% by mass or less (including 0%); and a galvanizing layer disposed on the base steel sheet, wherein a density of gaps in the galvanizing layer, the gaps cutting across the entire thickness of the galvanizing layer in a cross section of the steel sheet, the cross section being taken in a thickness direction of the steel sheet perpendicular to a rolling direction of the steel sheet, is 10 gaps/mm or more, and wherein the high-strength galvanized steel sheet has a tensile strength of 1000 MPa or more, and an average hole expansion of 25% or more to 70% or less.

2. The high-strength galvanized steel sheet according to claim 1, wherein desorption of the diffusible hydrogen peaks at a temperature in the range of 80° C. to 200° C.

3. The high-strength galvanized steel sheet according to claim 1, wherein the galvanizing layer is an alloyed galvanizing layer.

4. The high-strength galvanized steel sheet according to claim 2, wherein the galvanizing layer is an alloyed galvanizing layer.

5. A method for producing a high-strength galvanized steel sheet according to claim 1, the method comprising:

an annealing step in which a hot-rolled or cold-rolled steel sheet having the composition according to claim 1 is subjected to heating to an annealing temperature of 750° C. or more, then held as needed, and subsequently subjected to cooling such that an average cooling rate in a range of 550° C. to 700° C. is 3° C./s or more, the amount of retention time during which the steel sheet is held in a temperature range of 750° C. or more in the heating and the cooling being 30 seconds or more;

a galvanizing step in which, subsequent to the annealing step, the annealed steel sheet is galvanized and subsequently, as needed, subjected to an alloying treatment;

a bending-unbending step in which the galvanized steel sheet is bent and unbent in a direction perpendicular to a rolling direction of the steel sheet at a bend radius of 500 to 1000 mm in a temperature range of Ms to Ms−200° C. during cooling performed subsequent to the galvanizing step, each of the bending and the unbending being performed once or more;

a retention step in which the galvanized steel sheet is held for 3 s or more until the temperature reaches 100° C. after having been subjected to the bending-unbending step; and a final cooling step in which the galvanized steel sheet is cooled to 50° C. or less after having been subjected to the retention step.

6. The method for producing a high-strength galvanized steel sheet according to claim 5, wherein, in the annealing step, the $H_2$ concentration at the annealing temperature is 30% by volume or less.

7. The method for producing a high-strength galvanized steel sheet according to claim 5, wherein, in the annealing step, the $H_2$ concentration during the cooling performed in the temperature range of 550° C. to 700° C. is 30% by volume or less.

8. The method for producing a high-strength galvanized steel sheet according to claim 6, wherein, in the annealing step, the $H_2$ concentration during the cooling performed in the temperature range of 550° C. to 700° C. is 30% by volume or less.

* * * * *